United States Patent [19]

Hunt, III et al.

[11] Patent Number: 4,761,144

[45] Date of Patent: Aug. 2, 1988

[54] MOUNTING MEANS FOR RACK AND PANEL CONNECTOR

[75] Inventors: Alexander Hunt, III, Harrisburg; John M. Myer, Lancaster, both of Pa.

[73] Assignee: AMP Incorporated, Harrisburg, Pa.

[21] Appl. No.: 944,314

[22] Filed: Dec. 22, 1986

[51] Int. Cl.[4] ..... H01R 13/74

[52] U.S. Cl. ..... 439/545; 29/825; 439/557

[58] Field of Search ..... 439/545, 552, 557, 248; 29/825

[56] References Cited

U.S. PATENT DOCUMENTS

| | | | |
|---|---|---|---|
| 2,891,103 | 6/1959 | Swengel | 174/153 |
| 3,179,738 | 4/1965 | DeLyon . | |
| 3,308,417 | 3/1967 | Hammell et al. | 439/545 X |
| 3,966,291 | 6/1976 | Hug | 339/64 R |
| 3,989,343 | 11/1976 | Lucius et al. | 339/128 |
| 4,389,021 | 6/1983 | Coldren . | |
| 4,504,108 | 3/1985 | Fiumefreddo et al. | 439/557 |
| 4,647,130 | 3/1987 | Blair et al. . | |

FOREIGN PATENT DOCUMENTS 0020834 6/1979 European Pat. Off. .

OTHER PUBLICATIONS

AMP Catalog 76-362 Revised 9-83, "Metrimate Pin and Socket Connectors", AMP Incorporated, Harrisburg, Pa., pp. 3, 34, 35.

*Primary Examiner*—Eugene F. Desmond
*Attorney, Agent, or Firm*—Anton P. Ness

[57] ABSTRACT

A floating electrical connector for rack and panel connector systems capable of being inserted into and reliably retained within an opening in a panel without tools and without separate fastening elements. The connector includes a connector housing having first and second transverse slots on opposed first and second sides of the housing within which portions of the opening defining edge of the panel extend when the connector is mounted to the panel for longitudinally retaining the connector on the panel while permitting limited longitudinal movement of the connector relative to the panel. The connector also includes first and second retention means for laterally retaining the first and second sides of the connector in the opening while permitting limited lateral movement of the connector relative to the panel. The connector is mountable within a limited space on a panel and can withstand substantial forces encountered while being mated with or disconnected from a complementary connector.

12 Claims, 6 Drawing Sheets

100
111
112
113
116
117
121
122
123
124
131
132
133
134
136
12
104
106
103
141
18
10

202
226
D
232
228
204

210
212
238
236
214
208
200
222
230
234
218

238
212
214
236
210
206
224
218
222
230
220
218
216
208
200

MOUNTING MEANS FOR RACK AND PANEL CONNECTOR

BACKGROUND OF THE INVENTI0N

The present invention relates generally to electrical connectors and more particularly to the field of rack and panel connectors systems.

Connectors are known wherein one of a mating pair of multi-terminal electrical connectors is mounted on a rack panel and the other of the mating pair is mounted on the end of a drawer. The connectors are mated by inserting the drawer into the rack.

In rack and panel systems, access to the connectors is frequently not possible during mating; and the connectors must be "blind mated" to one another. To ensure proper alignment of the blind mated connectors, it is known to mount one of the connectors to be capable of moving or "floating" relative to the panel on which it is mounted to automatically align itself with the other connector during the mating process. One such rack and panel connector system is the METRIMATE Drawer Connector (trademark of AMP Incorporated, Harrisburg, Pa.). In the METRIMATE Drawer Connector, the plug connector of the mating pair is mounted on a drawer by two shoulder screws in a manner to provide a radial float mounting of the connector. Integrally molded guide pins on the mating end of the plug connector housing enter receiving recesses in the receptacle connector housing, and large tapered surfaces on the guide pins automatically align the plug and receptacle connector housing prior to mating of the plurality of male and female electrical terminals in the connectors. Alignment by the large tapered guide pins is possible because of the radial float mounting of the plug connector, permitting it to move laterally relative to the end panel of the drawer on which it is mounted during the mating process.

In many rack and panel connector systems, the connector members, particularly the floating connector member, could not be fully assembled until they were mounted to their respective panels in the field, thus presenting a problem of missing parts and system assembly in, frequently, an undesirable environment. In many designs, the floating connector member was secured to the panel by a plurality of screws or other separate fastening elements which increased assembly time and cost and was inconvenient to the worker. In many applications, design limitations necessitated that the floating connector member be mounted within a limited space on the panel; and the use of fastening screws and other components precluded fitting the connector within the available space.

In many prior rack and panel systems, the floating connector mount was not able to reliably withstand the often substantial forces that were encountered when the connector members were mated to or disconnected from one another. In some applications, for example, mating of the connector members is accomplished by robot arms which can apply significant forces to the connectors during the mating process.

SUMMARY OF THE INVENTION

The present invention provides an electrical connector assembly of the rack and panel type which includes a floating connector capable of being easily mounted to a panel without tools and without separate fastening elements. The connector of one embodiment is adapted to be inserted into and retained within an opening in the panel at least a portion of which is defined by an opening defining edge of the panel. The connector includes means for defining first and second slots extending transversely into the connector from first and second substantially opposite sides for receiving first and second portions, respectively, of the opening defining edge of the panel for longitudinally retaining the connector in the panel opening; and first and second retention means on the connector for cooperating with first and second edge features in the opening defining edge for laterally retaining the connector in the panel opening while permitting limited lateral movement of the connector relative to the panel.

According to one presently preferred first embodiment, the first and second edge features comprise first and second recesses in the opening defining edge of the panel. The first retention means comprises an internal rib within the first slot adapted to extend into the first recess when the connector is mounted within the opening to laterally retain the first side of the connector within the opening while permitting limited lateral movement of the first side of the connector relative to the panel. The second retention means comprises a resilient latching member integral with the connector and adapted to extend into the second recess when the connector is mounted within the opening to laterally retain the second side of the connector within the opening while permitting limited lateral movement of the second side of the connector relative to the panel.

Preferably also, the width of the first and second slots is greater than the thickness of the panel to permit limited longitudinal movement of the connector relative to the panel such that the connector is capable of limited movement longitudinally, laterally, and angularly relative to the panel to automatically compensate for a misaligned mating connector during the mating process.

The opening in the panel for the first embodiment preferably comprises a cutout extending into the panel from a peripheral edge thereof. To mount the connector to the panel, the first side of the connector is inserted into the cutout from the side of the panel such that the internal rib extends into the first recess and the first edge portion of the panel extends into the first slot of the connector. The second side of the connector is then rotated laterally into the cutout until the second edge portion extends into the second slot of the connector. When the second side of the connector is fully inserted into the cutout, a locking finger on the latching member snaps into the second side of the connector and the connector as a whole from the cutout. The width of the slots and the dimensions of the recesses are chosen to provide approximately 0.06 inch of connector float in any direction within the panel to compensate for misalignment of a complementary connector during blind mating of the connectors.

The floating connector of the first embodiment of the present invention is a fully assembled unit which is mounted to a panel simply by inserting one side of the connector into a panel cutout from the side and rotating the opposite side of the connector laterally into the cutout until it automatically locks in position within the cutout. Final assembly of the connector during mounting is not required, nor are separate bolts or other fastening elements needed to secure the connector to the panel. Mounting of the connector to the panel requires no tools or trained personnel.

According to a second preferred embodiment a floating connector is mountable within a closed aperture of a panel where the aperture cutout comprises rectilinear edges matching the profile of the connector portion to be inserted therethrough and slightly larger to permit floating. Such a closed aperture retains somewhat more structural strength for the panel. Again the connector has opposed first and second slots. A first slot extends completely across an end of the mounting flange defined between a forward extended flange portion and a longer axially rearward extended flange portion, to receive a panel edge between the flange portions. A second slot is defined between a rear surface of a flange portion of the respective end of the connector, and a locking finger extending across the respective end of the connector along the rear surface. The locking finger is deflectable toward the side of the connector by a boss extending from the plane of the panel adjacent the cutout on the rear side of the panel. The connector is mounted by inserting the forward portion of the connector through the cutout until the forward extended flange portion engages the panel's first cutout edge; the connector is slightly tilted forwardly until the second cutout edge is along the second slot and against a forwardly facing side surface of the locking finger; the connector is moved transversely to receive the second cutout edge in the second slot at which time the panel boss is engaged by the locking finger and deflects it against spring bias, allowing the first cutout edge to slip past the forward extended flange portion and align with the first slot and against the longer rearward extended flange portion. With both cutout edges in respective slots the connector is mounted, and the locking finger is allowed to resile approximately centering the connector in the cutout by continued engagement with the panel boss.

Because separate mounting hardware is not required, the several embodiments of the connector of the present invention can be mounted within a limited space on the panel. Also, the connector can reliably withstand rather substantial forces during mating with or when being disconnected from a complementary connector. In particular, any mating or disconnecting forces will be applied against the rigid sidewalls of the slots in the connector body and not against the more fragile internal rib or latching member. Accordingly, the connector of the present invention is particularly suited for applications in which the rack and panel connector system is mated or disconnected by robotic or other mechanical means.

Further advantages and specific details of the invention will become apparent hereinafter in conjunction with the following detailed description of presently preferred embodiments.

DETAILED DESCRIPTION OF THE PREFERRED EMBODIMENTS

Figure 1:
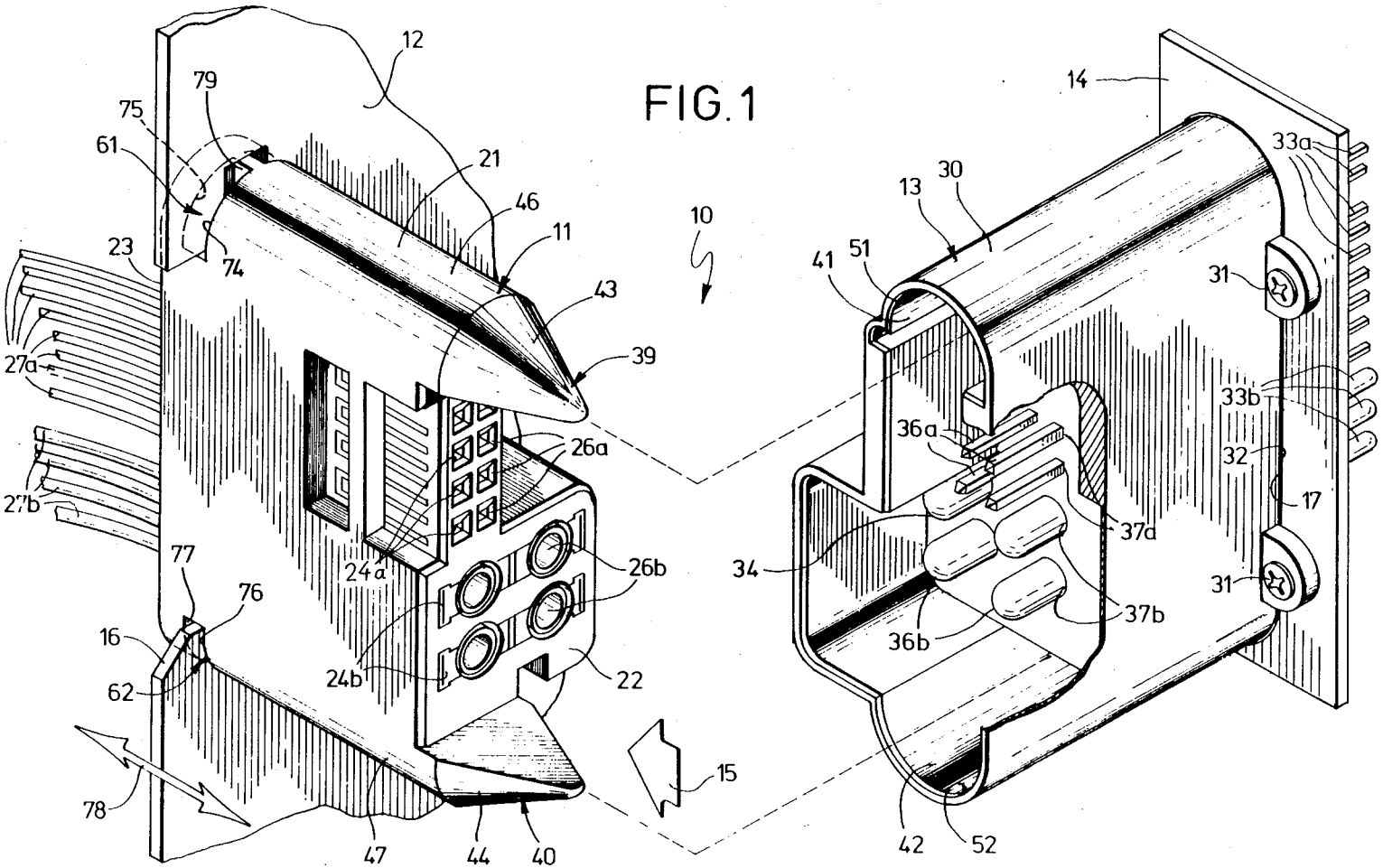
FIG. 1 is an assembly view of a rack and panel connector system according to one embodiment of the invention.

FIG. 1 illustrates an electrical connector system 10 which includes a first connector 11 mounted to a first panel 12, and a second connector 13 mounted to a printed circuit board 14. Connector system 10 comprises a rack and panel-type system in which first panel 12 comprises a stationary panel, and circuit board 14 is mounted to a larger assembly (not shown). As is well known to those skilled in the art, connectors 11 and 13 are mated when the assembly to which connector 13 and board 14 are mounted is brought up to panel 12 in the direction indicated by arrow 15.

Connector 11 comprises a plug connector mounted within an opening 16 in panel 12, and connector 13 comprises a receptacle connector mounted to board 14 on an assembly. Plug connector 11 contains a plurality of plug contact terminals **26*a* and 26*b* which terminate a plurality of electrical cables 27*a* and 27*b*, respectively; and receptacle connector 13 contains a plurality of receptacle contact terminals 36*a* and 36*b* which include a plurality of terminal posts 33*a* and 33*b*, respectively electrically connected to circuit paths of board 14. When the connectors 11 and 13 are mated, each plug contact terminal 26*a* and 26*b* in plug connector 11 is electrically connected with an aligned receptacle contact terminal 36*a* and 36*b* in receptacle connector 13** to complete electrical circuits (not shown) through the connectors.

Receptacle connector 13 is rigidly mounted to board 14 by a plurality of mounting screws 31 extended through aligned apertures in the connector housing and in board 14, respectively, or in another appropriate manner. As will be described in detail below, and in accordance with the present invention, plug connector 11 is mounted to panel 12 in a manner to permit the plug connector 11 to move or "float" relative to panel 12 to automatically compensate for misalignment between connector members 11 and 13 during the mating process.

Plug connector 11 comprises a one-piece, molded, dielectric housing 21 of, for example, a glass-filled polyester such as VALOX 420 SEO thermoplastic resin (trademark of General Electric Company). Housing 21 includes a front mating surface 22, a rear surface 23, and a plurality of terminal-receiving passageways **24*a* and 24*b* extending longitudinally through housing 21 from mating surface 22 to rear surface 23. Terminal-receiving passageways 24*a* and 24*b* carry and retain the plurality of electrical plug contact terminals 26a and 26b which terminate electrical cables 27a and 27b, respectively. Terminals 26a can, for example, comprise signal terminals attached to signal-carrying conductors in cables 27a; and terminals 26b can comprise power terminals coupled to power lines 27b**.

Receptacle connector 13 also preferably comprises a one-piece, dielectric housing 30 of glass-filled polyester and include a front mating surface 34 and a rear surface 32. A plurality of terminal-receiving passageways 37a and 37b extend longitudinally through housing 30 and carry and retain the plurality of electrical receptacle contact terminals 36a and 36b, respectively, with terminal posts 33a and 33b extending rearwardly therefrom.

Plug connector 11 and receptacle connector 13 are matable to form connector assembly 10. In rack and panel systems, access to the connectors is generally not possible during mating, and therefore the connectors must be blind mated to one another. To ensure alignment of the connectors with one another during mating, plug connector 11 is provided with a pair of guide pins 39 and 40 which are integral with housing 21 and which extend forwardly from opposite ends of mating face 22. Guide pins 39 and 40 are positioned to be received in alignment recesses 41 and 42, respectively, of receptacle connector 13 when the connectors are mated. Guide pins 39 and 40 preferably include alignment bearing surfaces 43 and 44 which comprise half conical surfaces on the outer sides of their forward ends. Alignment bearing surfaces 43 and 44 extend continuously forward from semi-cylindrical, axial side surfaces 46 and 47 of plug housing 21 and are smoothly tapered at an angle of about 30°. Recesses 41 and 42 in receptacle connector 13 contain internal, alignment-bearing surfaces 51 and 52 which cooperate with bearing surfaces 43 and 44 and guide pins 39 and 40.

When receptacle connector 13, mounted on board 14, is mated to plug connector 11 mounted on panel 12, guide pins 39 and 40 enter alignment recesses 41 and 42. Alignment-bearing surfaces 43 and 44 engage cooperating alignment-bearing surfaces 51 and 52 at certain points around the semi-circular hood sections of the connector bodies depending on the nature of any slight misalignment of the plug and receptacle connectors. Guide pins 39 and 40 are urged by the engagement of the bearing surfaces into alignment with the recesses 41 and 42 to ensure that the connectors are aligned during the mating process.

As will be described below, automatic alignment of the two connectors is possible because plug connector 11 is floatingly mounted to panel 12 in such a way that it can move longitudinally, laterally, and angularly relative to panel 12 to compensate for misalignment of the connectors. After alignment, the terminals in the two connectors engage with one another to complete electrical connection through the connector assembly.

Contact terminals 26a and 26b and 36a and 36b in the plug and receptacle connectors, respectively, do not form part of the present invention and, accordingly, are not described in detail herein; in most Figures, the terminals and conductors are shown symbolically rather than in detail. Preferably, the contact terminals are stamped and formed of a tin plated brass, but may be of a phosphor bronze alloy which are selectively gold plated at contact portions and selectively tin plated at connection portions at which they are terminated to respective electrical conductors or to be soldered to circuit paths of board 14. Wire termination may be by crimping, insulation displacement, soldering, or welding as is known to those skilled in the art. The terminals may also be of the type disclosed in commonly assigned pending U.S. patent application Ser. No. 875,917 of Bryce Wilson Blair et al., entitled "MOUNTING MEANS FOR HIGH DURABILITY DRAWER CONNECTOR" or of another construction.

Figure 2:
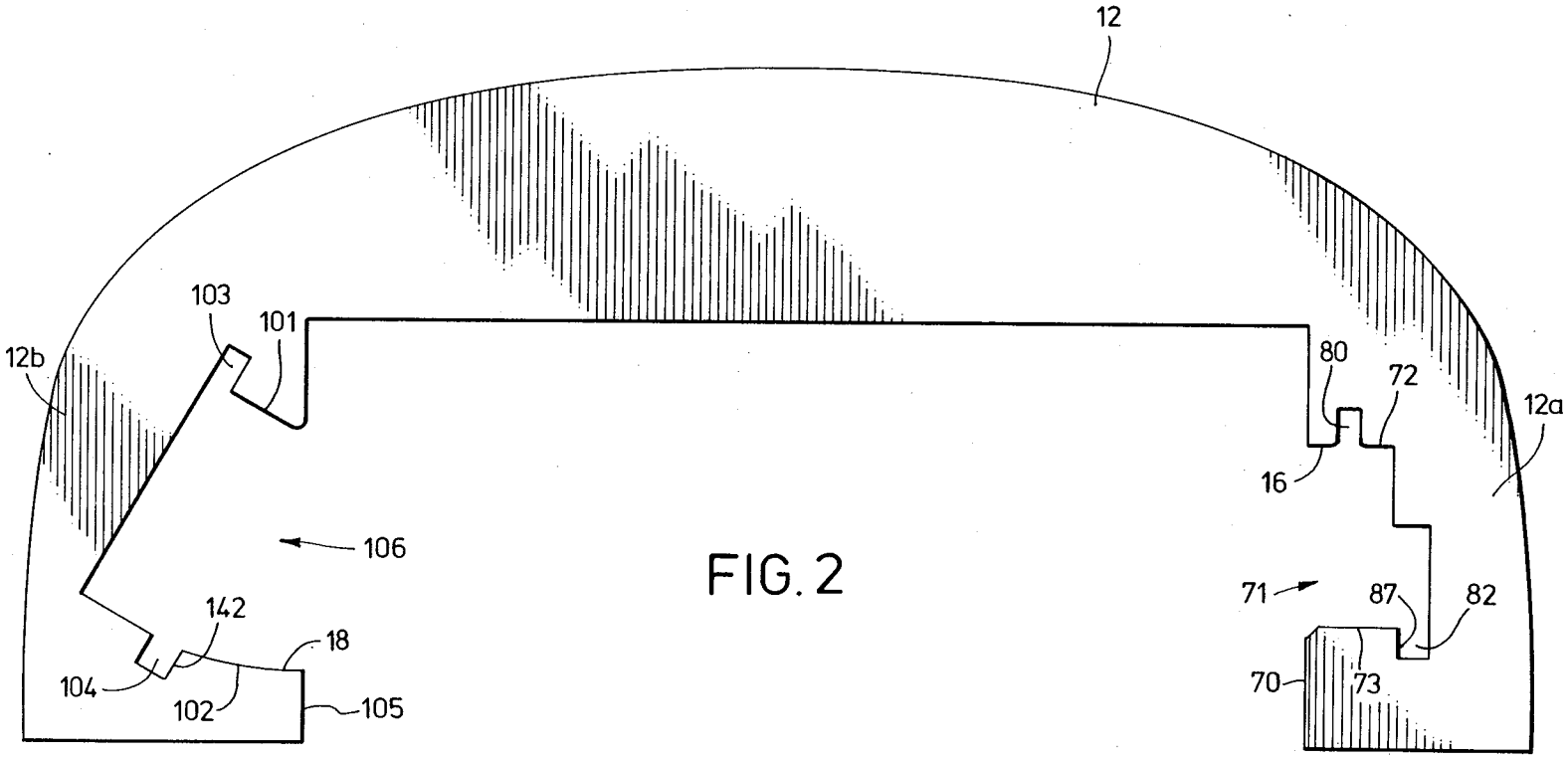
FIG. 2 is a panel to which floatable connectors of the present invention are mounted.
Figure 3:
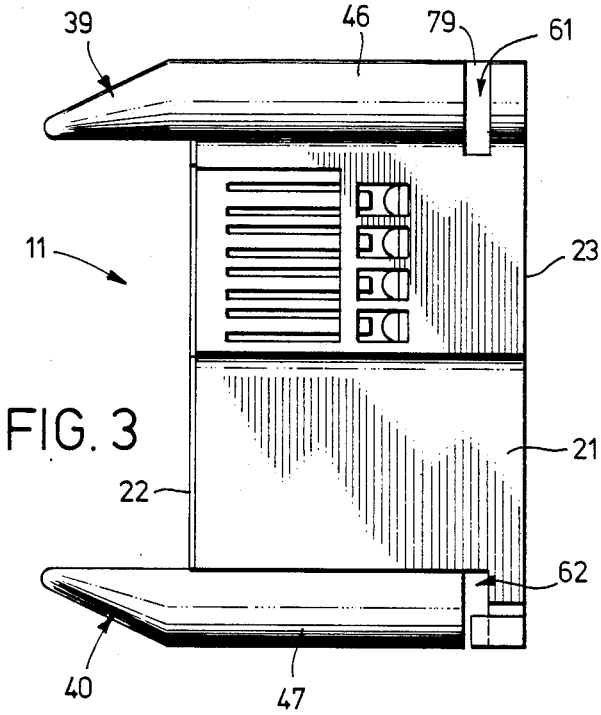
FIG. 3 is a side view of the floatable connector of FIG. 1.
Figure 4:
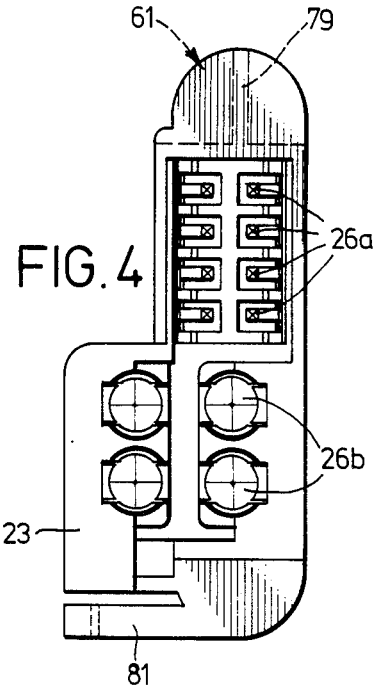
FIG. 4 is a back view of the floatabie connector of FIG. 1.
Figure 6:
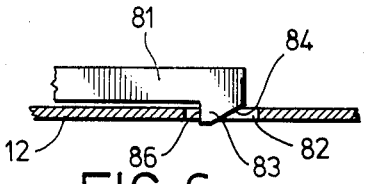
FIG. 6 is a cross-sectional view looking in the direction of arrows 6—6 in FIG. 5 illustrating the latching member of the floatable connector of FIGS. 1, and 3–5.

Panel 12 to which plug connector 11 is mounted is illustrated in greater detail in FIG. 2. Panel 12 is made of any suitable, rigid material such as a rigid plastic and, in the embodiments described herein, comprises an automobile instrument panel although it should be understood that it is not intended to limit the invention to any particular application. The present invention is particularly suitable for applications in which relatively limited space is available on a panel for float mounting a connector body; and in the panel shown in FIG. 2, connectors of the present invention are to be mounted in available triangular-shaped spaces 12a and 12b on opposite ends of the panel.

More particularly, as shown in FIG. 2, panel portion 12a is provided with an opening or cutout 16 which is adapted to receive plug connector 11 illustrated in FIGS. 1 and 3–6; and panel portion 12b is provided with a cutout 18 which is adapted to receive a plug connector 100 illustrated in FIGS. 7–10 and to be described below.

To mount plug connector 11 to panel 12, connector housing 21 includes a pair of transverse grooves or slots 61 and 62 adjacent rear surface 23 of the housing which extend into semi-circular side surfaces 46 and 47 of the housing. Slots 61 and 62 are of generally semi-circular shape and have a width slightly greater than the thickness of panel 12, as shown in FIG. 1, to receive opposed portions of the edge of panel 12 which define the cutout 16 when the connector is inserted into cutout 16. More particularly, with reference to FIG. 2, cutout 16 is formed in the peripheral edge 70 of panel portion 12a and has an open side 71 and top and bottom edges 72 and 73 defined by the opening defining edge of the panel; When connector 11 is positioned within cutout 16, a portion of top edge 72 extends into upper slot 61; and a portion of bottom edge 73 extends into lower slot 62 as shown in FIG. 1. When connector 11 is positioned within cutout 16, therefore, sidewalls 74 and 75 of upper slot 61 and sidewalls 76 and 77 of lower slot 62 define flanges to prevent withdrawal of the upper and lower sides of the connector from cutout 16 in the longitudinal direction as indicated by arrow 78 in FIG. 1. Limited longitudinal movement of connector 11 relative to panel 12 is permitted, however, because slots 61 and 62 are somewhat wider than the thickness of panel 12.

Figure 5:
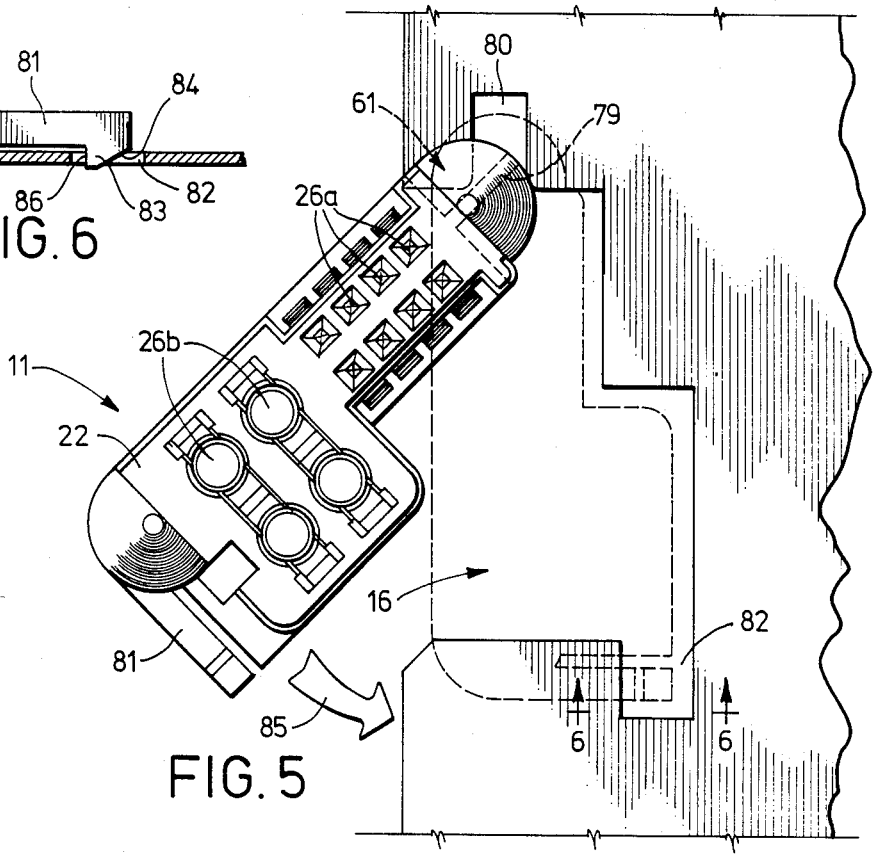
FIG. 5 is a front view of the floatable connector of FIGS. 1, 3, and 4 being mounted to the panel of FIG. 2.

Slot 61 is divided into two, substantially equal-sized quadrants by a centrally located, internal rib 79. Rib 79 is adapted to extend into a rectangular-shaped recess 80 in upper opening defining edge 72 of panel 12, as shown in FIG. 5. Rib 79 comprises a first retention means on the connector for laterally retaining the connector in the cutout 16 while permitting limited lateral movement of the connector within the cutout.

Connector 11 further includes a latching member 81 formed in the lower side thereof which is adapted to cooperate with a second recess 82 in lower opening defining edge 73 of panel 12 to comprise second retention means for laterally retaining the connector in the cutout 16. Latching member 81 is preferably formed integral with plastic housing 21 and comprises a resilient elongated arm having a locking finger 83 extending from the end thereof at a substantially right angle. Locking finger 83 is configured to define a tapered camming surface 84 and a locking surface 86, as shown most clearly in FIG. 6.

To mount connector 11 to panel 12, the upper end of connector 12 is first inserted into cutout 16 through open side 71, as illustrated in solid line in FIG. 5, such that internal rib 79 within upper slot 61 extends into recess 80 as shown; and upper opening defining edge 72 of the panel on either side of recess 77 extends into slot 61. The connector is then rotated counterclockwise into cutout 16 as indicated by arrow 85. As it is rotated into cutout 16, lower opening defining edge 73 of the panel enters into lower slot 62 of the connector. The camming surface 84 on latching member 81 engages the back surface of the panel and is pushed out of the way to permit the connector to be inserted fully into the cutout. When, however, locking edge 86 of finger 83 clears edge 87 of recess 82, locking arm 81 springs forwardly (downwardly in the view of FIG. 6) such that finger 83 enters into recess 82 to lock the lower end of connector within cutout 16. Thereafter, locking edge 86 of finger 83, in cooperation with edge 87 of recess 82, prevents withdrawal of the connector from the cutout in the lateral direction opposite that of arrow 85.

Recesses 80 and 82 are sized to permit connector 11 to move laterally in any direction to a limited extent. As indicated above, the width of slots 61 and 62 are also such as to permit the connector to move longitudinally to a limited extent in the direction indicated by arrow 78 in FIG. 1. Preferably, the dimensions of the recesses and of the slots are such as to permit about 0.060 inch of "float" in any direction.

With the present invention, therefore, a connector is provided which can be float-mounted to a panel quickly without the use of tools or separate mounting hardware. If desired, the connector can be quickly removed from the panel by simply pushing the latching member 81 out of engagement with edge 87 of recess 82.

Connector 11 can also reliably withstand any forces that are likely to be encountered during mating or disconnecting connectors 11 and 13 when the assembly is brought up to panel 12 or moved therefrom. In particular, any forces applied during mating or disconnecting of the connectors are applied against the rigid walls 74,75,76, and 77 of slots 61 and 62 and not against the more fragile internal rib or latching member. Thus, the system of the present invention is particularly suited for applications in which an assembly having board 14 and connector 13 thereon is brought up to panel 12 in a manufacturing environment by robot arms or the like such as in automated assembly of automobiles. The connector of the present invention can also be fully assembled as a unit prior to mounting to a panel, reducing the risk of lost parts and the inconvenience of assembly in the field.

FIGS. 7–10 illustrate a floating connector 100 according to an alternative embodiment of the invention adapted to be mounted within a cutout 18 in panel portion **12*b* of panel 12 (FIG. 2). Cutout 18 is configured somewhat differently than cutout 16 and is defined by a side opening 106 in peripheral edge 105 of panel 12, and upper and lower opening defining edges 101 and 102 in the panel. A first recess 103 is formed in the upper panel edge 101, and a second recess 104 is formed in the lower panel edge 102 to cooperate with first and second retention means on connector 100 to laterally retain the connector 100 within cutout 18**.

Connector 100 is similar in construction to connector 11 and is only briefly described herein. Connector 100 comprises a connector housing 111 having a mating surface 112 and a rear surface 113. Connector 100 further includes tapered alignment surfaces 116 and 117 adapted to be received within alignment openings in a mating connector (not shown) which may be similar to openings 41 and 42 in mating connector 13 of FIG. 1.

Figures 7, 8, 9, 10:
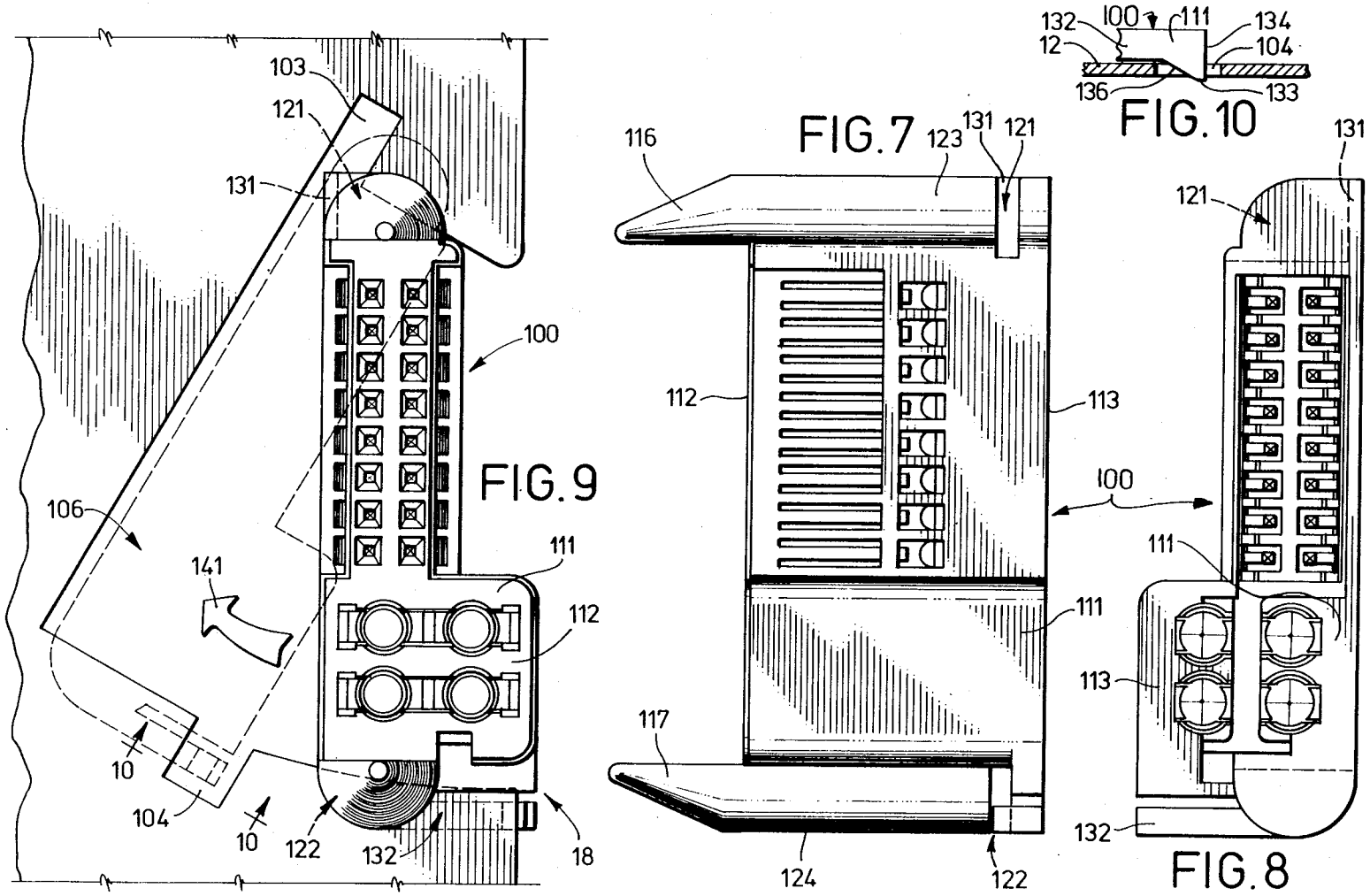
FIG. 7 is a side view of a floatable connector according to an alternative embodiment of the invention.
FIG. 8 is a back view of the connector of FIG. 7.
FIG. 9 is a front view of the connector of FIGS. 7 and 8 being mounted to the panel of FIG. 2.
FIG. 10 is a cross-sectional view looking in the direction of arrow 10—10 in FIG. 9 illustrating the latching member of the connector of FIGS. 7 to 9.
Figures 11, 12, 13:
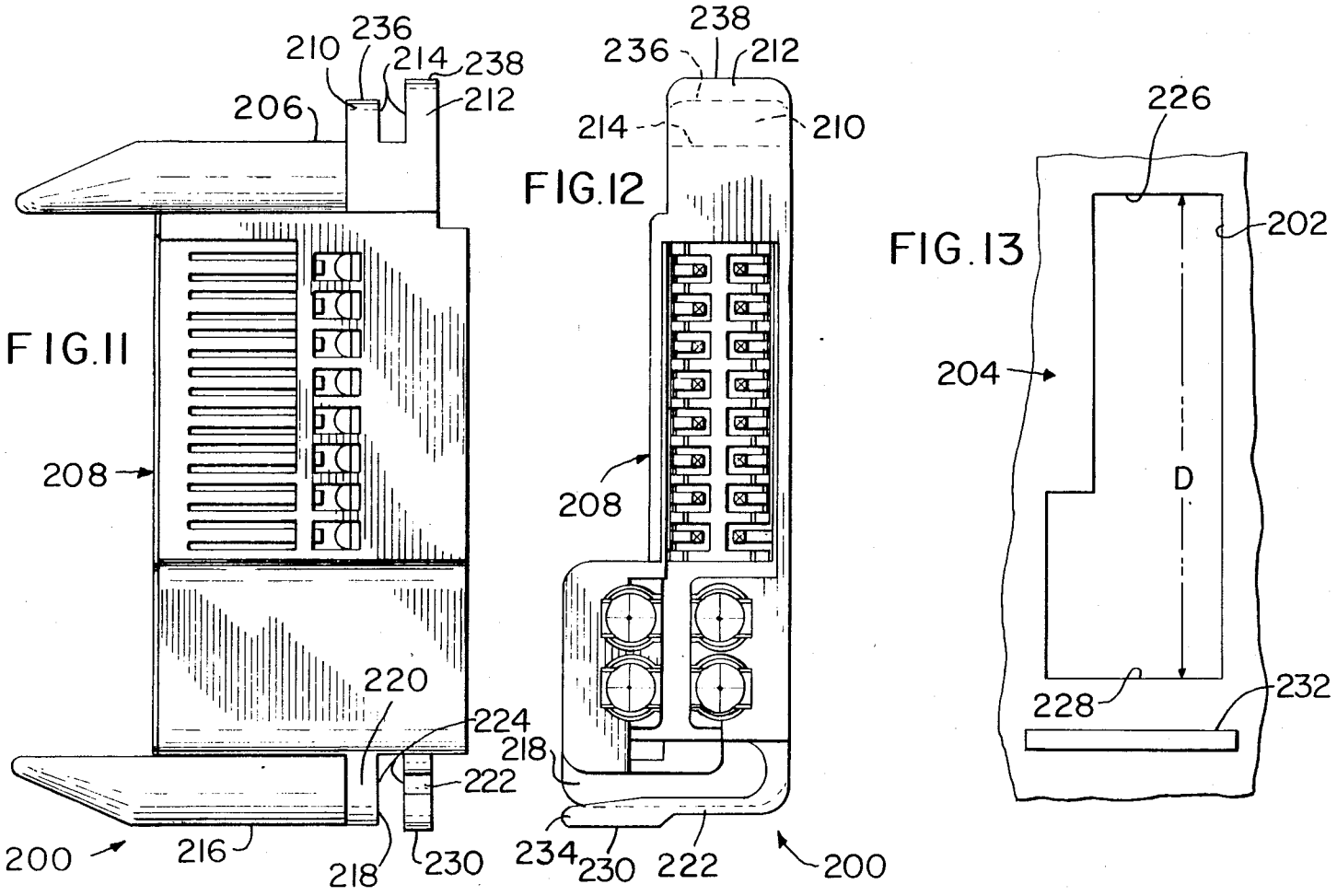
FIGS. 11 and 12 are elevational and rear views of yet another connector embodiment.
FIG. 13 is a panel cutout for the connector of FIGS. 11 and 12.

As best shown in FIG. 7, connector body 111 contains upper and lower transverse slots 121 and 122, respectively, adjacent rear surface 113 which extend into the semi-circular side surfaces 123 and 124, respectively, of connector housing 111. Slots 121 and 122 are of generally semi-circular shape and are adapted to receive portions of upper and lower opening defining edges 101 and 102 of panel 12 when connector 100 is mounted within cutout 18 to longitudinally retain the connector 100 in cutout 18. Upper slot 121 also contains an internal rib 131 which is located within slot 121 adjacent the side of the slot as best shown in FIG. 9. Rib 131 comprises first retention means adapted to extend into first recess 103 in cutout 18 to laterally retain the upper end of the connector within the cutout 18.

Connector 100 also includes a latching member 132 adjacent the lower end thereof. Latching member 132 is illustrated more clearly in FIG. 10 and includes an elongated arm integral with housing 111 and having a locking finger 133 extending from the end thereof. Locking finger 133 defines a locking surface 134 and a camming surface 136. Latching member 132 comprises second retention means to extend into recess 104 for laterally retaining the lower end of connector 100 within cutout 18.

Connector 100 is inserted into and mounted within cutout 18 in a manner similar to that of connector 11 in the embodiment of FIGS. 1 and 3–6. Initially, the upper end of connector 100 is inserted into the cutout through opening 106 such that internal rib 131 in slot 121 extends into recess 103 of the cutout 18 and a portion of the upper edge defining opening 101 of panel 12 extends into slot 121. Connector 100 is then rotated clockwise, as indicated by arrow 141, to insert the lower end of the connector into the cutout. As the connector enters the cutout, lower opening defining edge 102 of the panel enters into lower slot 122 of the connector. During insertion, the camming surface 136 of latching member 132 contacts the back surface of panel 12 and is pushed out of the way to permit the connector to be fully inserted into the cutout. When, however, locking surface 134 on the latching member clears the edge of recess 104, the latching member springs downwardly, as viewed in FIG. 10, to laterally retain the lower end of connector 100 in cutout 18.

As in the previous embodiment, dimensions of recesses 103 and 104 and the width of slots 121 and 122 are selected to provide approximately 0.060 inch of float of the connector relative to the panel in all directions.

Another embodiment of a connector of the present invention is illustrated in FIGS. 11 to 14D. Connector 200 is adapted to be mounted to the closed panel cutout 202 of panel 204 in FIG. 13 again without hardware. A closed panel cutout such as cutout 202 allows the panel to be continuous on both sides of the cutout providing structural strength to the panel especially important if the panel is plastic. However, the cutout may now be located remote from an edge of a panel in particular applications. Relatively upper or first end 206 of connector housing 208 includes a forward flange portion 210 extending outwardly a selected distance and a rearward flange portion 212 extending outwardly a selected farther distance, defining a first slot 214 therebetween. Relatively lower or second end 216 includes a rear surface 218 of a flange portion 220 and a locking finger 222 extending first laterally from second end 216 and then therealong and spaced therefrom, defining a second slot 224 therebetween.

Figures 14A, 14B, 14C, 14D:
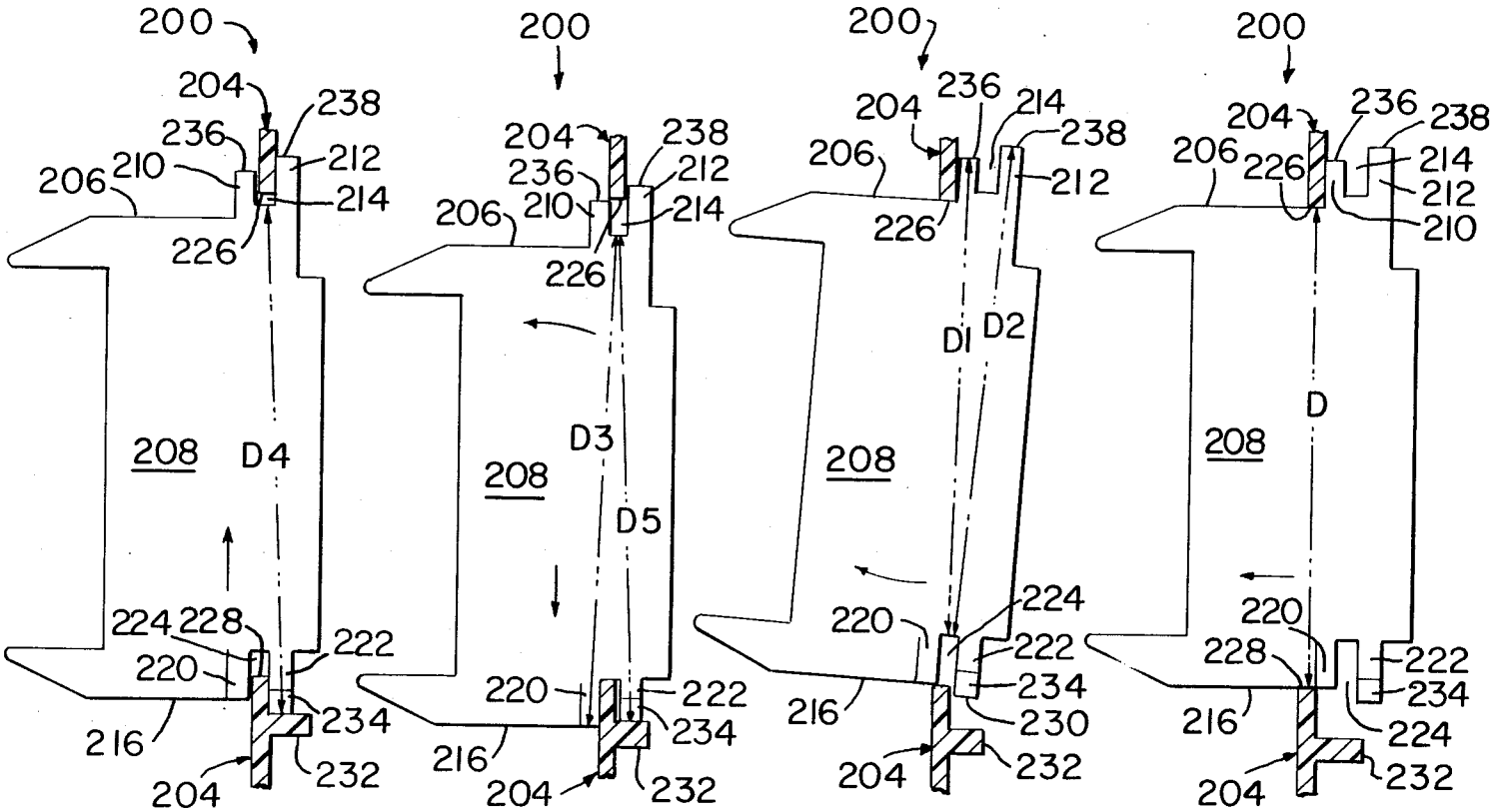
FIGS. 14A through 14D are diagrammatic representations of the method of mounting the connector of FIGS. 11 and 12 into the cutout of FIG. 13.

In FIGS. 14A to 14D connector 200 is inserted into and mounted within panel cutout 202 by means of a simple maneuvering or manipulation of the connector, and arrows indicate the movement of the connector. In FIG. 14A connector 200 is brought into panel cutout 202 such that upper or first cutout edge 226 is alongside first end 206 with panel 204 against the front surface of forward flange portion 210 and second cutout edge 228 alongside second end 216. In FIG. 14B, connector 200 is tilted forwardly at second end 216 so that lower or second cutout edge 228 is aligned with second slot 224, with outermost portion 230 of undeflected locking finger 222 extending farther outwardly past edge 228 to prevent connector 200 from being pushed entirely through cutout 202. In FIG. 14C connector 200 is moved laterally toward second end 216 such that second edge 228 enters slot 224 and panel boss 232 engages free end 234 of locking finger 222 and deflects free end 234 inwardly towards connector 200 against spring bias of locking finger 222 which permits connector 200 to be lowered far enough so that first cutout edge 226 passes over outer end 236 of forward flange portion 210 to align with first slot 214. Rearward flange portion 212 extends to an outer end 238 far enough outwardly past first panel edge 226 to prevent connector 200 from being pushed entirely through cutout 202. As shown in FIG. 14D when both panel edges 226,228 are aligned with respective slots 214,224 deflected locking finger 222 resiles against panel boss 230 and moves connector 200 vertically to be substantially centered within panel cutout 202 where it is now floatingly but securely mounted. It can be seen that disassembly of connector 200 from panel 204 is easily possible by reversing the steps described above.

As can be seen from FIGS. 14A through 14C the relationships of the distances between various outer surface portions of connector 200 to dimension D of panel cutout 202 are selected to allow the mounting method described above, with D itself selected to allow floating of connector 200 such as being 0.120 inches greater than the connector length (between the bottoms of the slots) to allow 0.06 inches clearance in each direction. The distance relationships are as follows: $D_1$ is the distance between outer end 236 of forward flange portion 210 and the bottom of second slot 224 and is less than D; $D_3$ is the distance between second connector end 216 and the bottom of first slot 214 and is also less than D; $D_3$ is the distance between outer end 238 of rearward flange portion 212 and the bottom of second slot 224 and is greater than D; $D_4$ is the distance between the bottom of first slot 214 and the outermost portion 230 of locking finger 222 when undeflected, and is greater than D; and $D_5$ is the distance between the bottom of first slot 214 and the outermost portion of locking finger 222 when deflected, such as by panel boss 232.

While what has been described constitutes presently preferred embodiments of the invention, the invention could take numerous other forms. Accordingly, it should be understood that the invention should be limited only insofar as is required by the scope of the following claims.

We claim:

1. An electrical connector adapted to be inserted into and retained within an opening in a panel, at least a portion of the opening being defined by an opening defining edge of the panel, and the opening defining edge including first and second substantially opposing edge portions at least a first one of which includes a recess, said connector comprising an article including:

means for defining first and second slots extending transversely into said connector from first and second substantially opposite sides of said connector for receiving first and second portions, respectively, of said opening defining edge of said panel for longitudinally retaining said connector in said panel opening; and first and second retention means on said connector for cooperating with first and second edge features in said opening defining edge for laterally retaining said connector in said panel opening while permitting limited lateral movement of said connector relative to said panel, said first retention means comprising an internal rib within said first slot and wherein said first edge feature comprises a first recess in said first side of said opening defining edge said internal rib extending into said first recess when said connector is positioned within said opening for laterally retaining said first side of said connector in said panel opening while permitting limited lateral movement of said first side of said connector relative to said panel.

2. The connector of claim 1 wherein said second retention means comprises a resilient latching member extending from said connector, and wherein said second edge feature comprises a second recess in said opening defining edge, said latching member extending into said second recess when said connector is positioned within said opening for laterally retaining said second side of said connector in said opening while permitting limited lateral movement of said second side of said connector relative to said panel.

3. The connector of claim 1 wherein the width of said first and second slots is greater than the thickness of said panel for permitting limited longitudinal movement of said connector relative to said panel.

4. The connector of claim 1 wherein said resilient latching member includes a camming surface cooperating with said panel during insertion of said connector into said opening to permit insertion of said connector into said opening, and a locking surface extending into said second recess when said second side of said connector is positioned within said second recess for laterally retaining said second side of said connector in said opening while permitting limited lateral movement of said second side of said connector relative to said panel.

5. An electrical connector adapted to be float-mounted within a cutout in a panel, said cutout extending into said panel from a peripheral edge thereof and being partially defined by an opening defining edge of said panel, said opening defining edge including first and second recesses on substantially opposite sides of said cutout, said connector comprising:

a connector housing having electrically conductive contact means extending longitudinally therethrough;

means for defining first and second slots extending transversely into said housing from first and second substantially opposite sides of said connector for receiving portions of said opening defining edge of said panel when said connector is mounted within said cutout for longitudinally retaining said connector in said cutout, said first and second slots having a width greater than the thickness of said panel for permitting limited longitudinal movement of said connector relative to said panel;

an internal rib within said first slot, said internal rib extending into said first recess when said connector is mounted within said cutout for laterally retaining said first side of said connector within said cutout while permitting limited lateral movement of said first side of said connector relative to said panel; and latching means on said connector, said latching means extending into said second recess when said connector is mounted within said cutout for laterally retaining said second side of said connector within said cutout while permitting limited lateral movement of said second side of said connector relative to said panel.

6. The connector of claim 1 wherein said connector housing further includes guide means for automatically aligning said connector with a complementary connector during mating therewith.

7. The connector of claim 6 wherein said latching means comprises a resilient latching member integral with said connector housing, said latching member permitting insertion of said second side of said connector into said cutout and thereafter engaging said second recess for preventing withdrawal of said second side of said connector from said cutout.

8. The connector of claim 7 wherein said latching member comprises a resilient arm integral with said housing and having a latching finger at the end thereof, said latching finger having a camming surface cooperating with said panel for permitting insertion of said connector into said cutout, and a locking surface extending into said second recess when said connector is positioned in said cutout for laterally retaining said second side of said connector in said cutout while permitting limited lateral movement of said second side of said connector relative to said panel.

9. An electrical connector adapted to be inserted into and retained within an opening in a panel, the opening including first and second substantially opposing edge portions, said connector comerising an article including;

means for defining first and second slots extending transversely into said connector from first and second substantially opposite ends of said connector for receiving first and second edge portions respectively of said panel opening for longitudinally retaining said connector in said panel opening; and first and second retention means on said connector for cooperating with said first and second edge portions for retaining said connector in said panel opening while permitting limited lateral movement of said connector relative to said panel, said first retention means comprising forward and rearward flange portions extending outward from said first end of said connector comprising side walls of said first slot and said rearward flange portion extends outwardly a distance such that the distance between the outer end thereof and the bottom of said second slot exceeds the distance between said first and second edge portions of said panel cutout, and the distance between the outer end of the forward flange portion and said bottom of said second slot is less than said distance between said first and second edge portions of said panel cutout.

10. An electrical connector as set forth in claim 9 wherein said second retention means comprises a forward side of said second slot having an outer surface a distance from the bottom of said first slot less than the distance between said first and second edge portions of said panel cutout, and a resilient latching member extending from said second connector end first laterally therefrom and then parallel thereto to a free end and comprising a rearward side of said second slot, said latching member free end being deflectable toward said second connector end and having an outermost portion disposed outwardly a distance such that the distance between the outer edge thereof and the bottom of said first slot exceeds the distance between said first and second edge portions of said panel cutout when said latching member is undeflected and is less than said distance when deflected.

11. An electrical connector as set forth in claim 10 wherein said outermost portion of said latching member free end is adapted to urge the connector to a centered position vertically in said panel cutout when said latching member is undeflected.

12. A method of mounting an electrical connector to a panel through a cutout thereof comprising the steps of:

extending a forward portion of a selected connector having a first side and a second side opposed thereto through a panel cutout between a first cutout edge and a second cutout edge opposed therefrom with said second cutout edge received into a second slot extending into said second side, said first cutout edge abutting a forward surface of a first flange portion of said first side forwardly of a first slot and therealong and a latching member along said second side abutting a stop means of said panel and undeflected thereby holding said connector spaced from said second cutout edge a selected distance;

deflecting a free end of said latching member toward said second side and moving said connector toward said second cutout edge;

moving said first flange portion along and past said first cutout edge and aligning said first cutout edge with said first slot; and allowing said free end of said latching member to resile moving said connector toward said first cutout edge whereby said first and second cutout edges are disposed in said first and second slots respectively.

* * * * *